US007575333B2

(12) United States Patent
Julia Vilarrasa

(10) Patent No.: US 7,575,333 B2
(45) Date of Patent: Aug. 18, 2009

(54) SUBMERSIBLE SPOTLIGHT

(75) Inventor: Joan Julia Vilarrasa, Sant Jaume de Llierca (ES)

(73) Assignee: Sacopa, S.A.U., Girona (ES)

( * ) Notice: Subject to any disclaimer, the term of this patent is extended or adjusted under 35 U.S.C. 154(b) by 0 days.

(21) Appl. No.: 11/715,523

(22) Filed: Mar. 8, 2007

(65) Prior Publication Data

US 2007/0230194 A1 Oct. 4, 2007

(30) Foreign Application Priority Data

Mar. 28, 2006 (ES) ..... 200600703 U

(51) Int. Cl.
*F21V 33/00* (2006.01)

(52) U.S. Cl. ..... 362/101; 362/800; 362/234; 362/96

(58) Field of Classification Search ..... None
See application file for complete search history.

(56) References Cited

U.S. PATENT DOCUMENTS

| | | | | |
|---|---|---|---|---|
| 3,339,066 | A * | 8/1967 | Hart | 362/267 |
| 4,729,076 | A * | 3/1988 | Masami et al. | 362/235 |
| 5,122,936 | A * | 6/1992 | Guthrie | 362/101 |
| 5,785,418 | A * | 7/1998 | Hochstein | 362/373 |
| 7,204,602 | B2 * | 4/2007 | Archer | 362/101 |
| 7,244,037 | B2 * | 7/2007 | Koren | 362/101 |
| 2005/0036305 | A1 | 2/2005 | Kersey | |
| 2006/0176686 | A1 | 8/2006 | McVicker | |
| 2006/0187652 | A1 * | 8/2006 | Doyle | 362/96 |
| 2007/0097675 | A1 * | 5/2007 | Koren et al. | 362/158 |
| 2007/0139913 | A1 * | 6/2007 | Savage | 362/101 |

FOREIGN PATENT DOCUMENTS

| | | | |
|---|---|---|---|
| DE | 20 2004 015830 | U1 | 1/2005 |
| DE | 10 2005 040185 | A1 | 3/2007 |
| EP | 1 460 333 | A | 9/2004 |

OTHER PUBLICATIONS thefreedictionary.com (acrylic resin definition) Retrived Aug. 12, 2007. http://www.thefreedictionary.com/p/acrylic+resin.*

* cited by examiner

*Primary Examiner*—Bao Q Truong
*Assistant Examiner*—Danielle Allen
(74) *Attorney, Agent, or Firm*—Merchant & Gould P.C.

(57) ABSTRACT

A spotlight includes a body (1) with a transparent front (2) and has LED's (5) as light-emitting elements. This spotlight body (1) and the transparent front (2) are made of plastic material and the printed circuit (6) including the LED's (5) is arranged in a juxtaposed arrangement on a metal plate (4) being fit to dissipate the heat being produced by the LED's, the metal plate being cooled by the water flowing into the body (1) of the spotlight through lateral openings (8) being provided in the body. The body (1) is concavely shaped and has the dissipator plate (4) securely attached to it at its open front end, the body (1) having at its center an inner pillar having a hollowed-out portion (10) and an outer open end (11) to receive the spotlight's electric connections (13 and 14) that will be fitted to it. The dissipator plate (4) is securely attached to the peripheral open front end of the body (1) and onto its central pillar (9) with the intermediary of respective O-ring seals (15 and 16).

13 Claims, 1 Drawing Sheet

SUBMERSIBLE SPOTLIGHT

FIELD OF THE INVENTION

This spotlight is mainly designed for the lighting of swimming pools in a water-submerged state, but it can also be used for ornamental fountains and even as a light projector outside the water.

BACKGROUND OF THE INVENTION

Different types of submersible spotlights are already known, parabolic lamps having been used for some time now which are known as "PAR 56" and are formed by a body and a lens being both made of glass, said lamps comprising as a light-emitting element an incandescent filament bulb, the body having an inner metal coating serving as a reflector. In this kind of spotlights LED's have been recently used instead of the bulb, said LED's possibly being of different colors such as for example red, blue and green, in order to thus obtain different lighting combinations, the body being made of metal and the lens being made of glass.

SUMMARY OF THE INVENTION

The object of the invention is a submersible spotlight of the type comprising as light-emitting elements LED's possibly being all white or of different colors. This novel light-emitting spotlight represents a notable improvement to the manufacture of this kind of submersible spotlights, a characterizing feature lying in the fact that the body and the glass are each obtained as a molding being made of plastics material, their manufacture being thus sensibly simplified and their cost being thus more reduced, both members thus forming a solid and undeformable assembly.

An also characterizing feature lies in the cooling mode being used in order to evacuate the heat being produced by the LED's. The printed circuit comprising the LED's is for such a purpose arranged in a juxtaposed arrangement on a metal plate being provided for dissipating said heat, said metal plate being cooled by the water flowing into the spotlight body, this latter for such a purpose having lateral openings being provided therein.

The electric connections of the spotlight are arranged at a hollow pillar being provided at the center of the body and having an outer open end, said electric connections being thus isolated from the water flooding said body.

The dissipator plate is securedly attached to the open front end of the body having a concave make-up, and onto the central pillar with the intermediary of seals allowing to tightly seal the cooling chamber being formed in the body.

These and other characterizing features will be best made apparent by the following detailed description whose understanding will be made easier by the accompanying sheet of drawings showing a practical embodiment being cited only by way of example not limiting the scope of the present invention.

DETAILED DESCRIPTION

Figure 2:
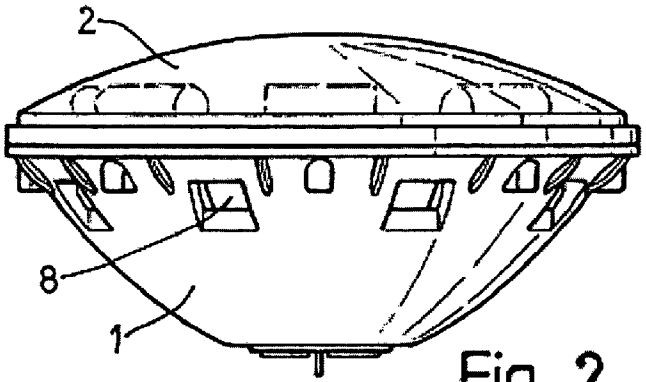
FIGS. 1 and 2 show the submersible spotlight being the object of the invention as seen in a perspective view and in a plan-view, respectively.
Figure 4:
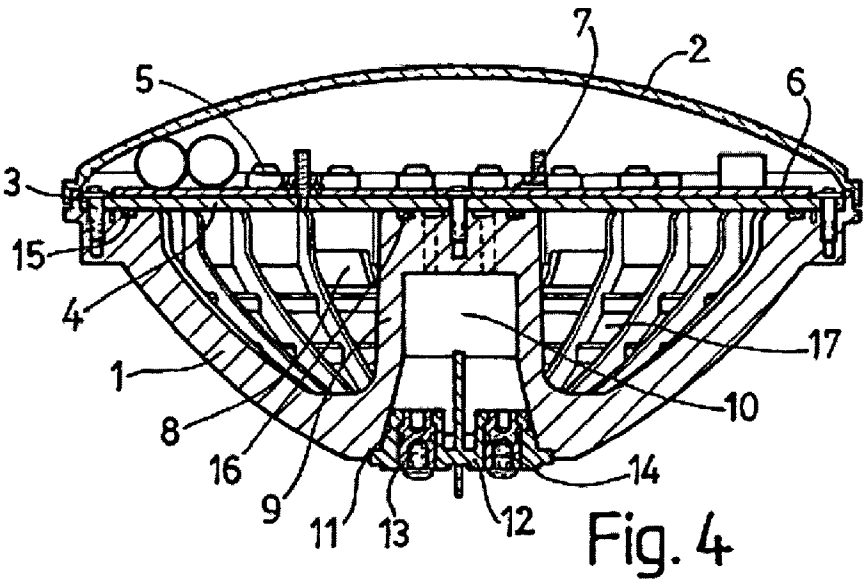
FIG. 4 is a cross-sectional view of the spotlight.
Figure 1:
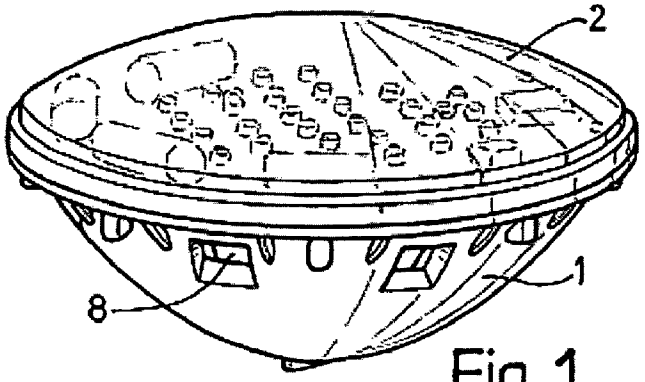
Figure 3:
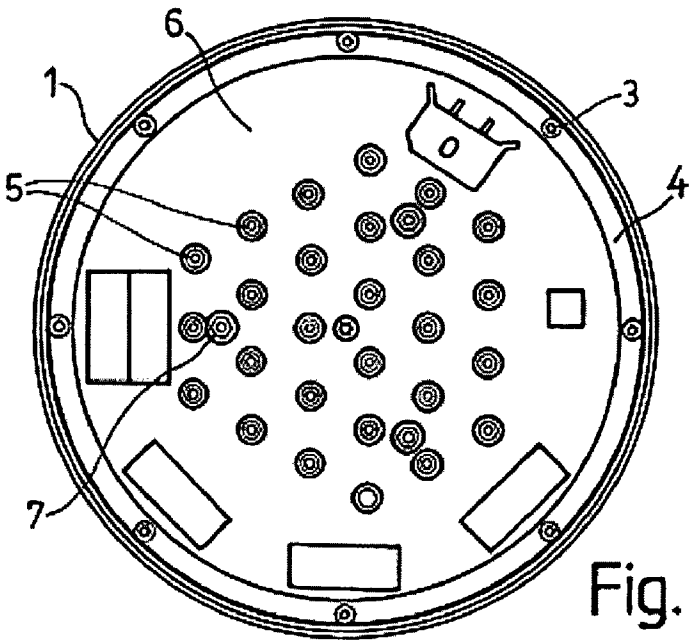
FIG. 3 illustrates in an elevational view the aforementioned spotlight without the transparent front.

According to the drawings this submersible spotlight comprises a body (1) and a transparent front (2) (lens) being made of plastics material, both parts being welded together and thus tightly fitted to each other in a sealed arrangement.

The body (1) is concavely shaped and has a rustproof metal plate (4) securedly attached to it at its open front end by means of screws (3), said metal plate being provided for dissipating the heat being generated by the LED's (5) being connected to the printed circuit (6) being securedly attached in a juxtaposed arrangement onto said plate by means of nuts (7).

The dissipator plate (4) is cooled by the water that will flow into the body (1) through openings (8) being laterally provided in its concave wall.

At the center of the body (1) there exists an inner pillar (9) forming a hollowed-out portion (10) with an outer open end (11) being fit to receive a stopper (12) that will be tightly fitted to it in a sealed arrangement and comprises sockets (13) and (14) for the electric connection of the spotlight.

The dissipator plate (4) is securedly attached to the peripheral open front end of the body (1) and onto the central pillar (9) with the intermediary of respective O-ring seals (15) and (16) thus tightly sealing the chamber (17) being formed in the body (1) for receiving the water flowing into it.

This submersible spotlight has the format of the "PAR 56" parabolic lamps and is hence in a position to replace them and to thus produce the aforementioned multicolor effects while at the same time notably reducing the power consumption and reaching a longer duration. This spotlight can form part of a lighting system being actuated by a radio remote control.

The invention claimed is:

1. A submersible spotlight comprising:

a body including a rear body portion defining lateral orifices formed through the rear body portion and a transparent front portion sealed against the rear body portion; wherein the rear body portion is concavely shaped and includes a central inner pillar, the central inner pillar having a cylindrical sidewall extending from a rear to a front of the rear body portion, a closed front end and rear outer open end; and a light emitting assembly comprising a plurality of light emitting diodes on a printed circuit mounted directly against a metal dissipator plate attached to the rear body portion at an open front end and configured to dissipate the heat being produced by said plurality of light emitting diodes, said metal plate being cooled by the water flowing into the body of the spotlight through the lateral orifices in said rear body portion.

2. A submersible spotlight as per claim 1, wherein the dissipator plate is attached to the peripheral open front end of the rear body portion with a first intermediate O-ring seal and onto the central inner pillar with a second intermediate O-ring seal.

3. A submersible spotlight as per claim 1, wherein the lateral orifices are spaced about a periphery of the rear body portion.

4. A submersible spotlight as per claim 1, wherein the body is removably mounted to an underwater structure.

5. A submersible spotlight as per claim 1, wherein the central pillar extends to and supports the metal dissipator plate.

6. A submersible spotlight according to claim 1, further comprising a stopper inserting into the outer open end of the center pillar and engaging the cylindrical sidewall in a sealing arrangement.

7. A submersible spotlight according to claim 6, wherein the stopper comprises electrical sockets configured for receiving electrical connectors.

8. A submersible spotlight according to claim 1, wherein the body and the dissipator plate define a sealed chamber enclosing the printed circuit board.

9. A submersible spotlight comprising:

a housing including:

a rear outer wall portion having lateral orifices, wherein the rear outer wall portion has an open front end and tapers from front to rear, a transparent front portion sealed against the rear outer wall portion, a central tube portion extending from a rear of the outer wall portion toward the front portion; the central tube portion having a closed inner end, an outer open end, and a substantially cylindrical sidewall defining a passage extending toward the front portion adapted to receive the spotlight's electric connections; and a light emitting assembly comprising light emitting diodes on a printed circuit mounted on and directly contacting a metal dissipation plate configured to dissipate the heat being produced by the light emitting diodes, the metal plate attaching to the rear outer wall portion at the open front end and supported by the inner end of the central tube portion and being cooled by water flowing into the housing through the lateral orifices in the rear outer wall portion.

10. A submersible spotlight according to claim 9, wherein the housing and dissipation plate define a water tight chamber around the printed circuit board.

11. A submersible spotlight according to claim 9, wherein the dissipation plate is attached to the peripheral open front end of the rear outer wall portion with a first intermediate O-ring seal and is attached to the central tube portion with a second intermediate O-ring seal.

12. A submersible spotlight according to claim 9, further comprising a stopper inserting into the outer open end of the center tube portion in a sealing arrangement.

13. A submersible spotlight according to claim 12, wherein the stopper comprises electrical sockets configured for receiving electrical connectors.

* * * * *